US006916450B2

(12) United States Patent
Akama et al.

(10) Patent No.: US 6,916,450 B2
(45) Date of Patent: Jul. 12, 2005

(54) EXHAUST GAS PURIFYING SYSTEM AND METHOD

(75) Inventors: Hiroshi Akama, Kanagawa (JP); Hiroaki Kaneko, Yokohama (JP); Junji Itou, Yokohama (JP); Motohisa Kamijo, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 617 days.

(21) Appl. No.: 09/930,279

(22) Filed: Aug. 16, 2001

(65) Prior Publication Data

US 2002/0053202 A1 May 9, 2002

(30) Foreign Application Priority Data

Sep. 8, 2000 (JP) ..... 2000-273771
Apr. 27, 2001 (JP) ..... 2001-133085

(51) Int. Cl.[7] ..... B01D 53/34; B01D 53/56
(52) U.S. Cl. ..... 422/180; 422/171; 422/177; 60/297
(58) Field of Search ..... 422/168–171, 422/177, 180; 60/297, 299

(56) References Cited

U.S. PATENT DOCUMENTS 4,902,487 A 2/1990 Cooper et al. ..... 423/215.5
5,961,931 A * 10/1999 Ban et al. ..... 422/171
6,669,913 B1 * 12/2003 Haberkamp ..... 422/180

FOREIGN PATENT DOCUMENTS

| | | |
|---|---|---|
| JP | 61-112716 | 5/1986 |
| JP | 1-318715 | 12/1989 |
| JP | 7-189656 | 7/1995 |
| JP | 8-312331 | 11/1996 |
| JP | 8-338229 | 12/1996 |
| JP | 2600492 | 1/1997 |
| JP | 10-180096 | 7/1998 |
| JP | 10-290921 | 11/1998 |
| JP | 11-13455 | 1/1999 |
| JP | 11-290624 | 10/1999 |

OTHER PUBLICATIONS

Hideaki UENO et al., "Development of Catalyst for Diesel Engine," TOYOTA Technical Review vol. 47, No. 2, Nov. 1997, pp. 108–113.
Ritsuko Shinozaki et al., "The Durability of and Evaluation Methods for Diesel Oxidation Catalysts," Society of Automotive Engineers of Japan, No. 103–98, 1998, pp. 13–16.
J. P. Warren et al., "Effects of Aftertreatment on Particulate Matter When Using the CRT™ (Continuously Regenerating Trap." ImechE 1998, S491/006, pp. 2–7.
B. Carberry et al., "A Focus on Current and Future Particulate Aftertreatment Systems," ImechE 1998, S491/007, pp. 57–73.
Richard Stone, "Introduction to Internal Combustion Engines," Society of Automotive Engineers, Inc., Third Edition, 1999, pp. 598–600.

(Continued)

*Primary Examiner*—Hien Tran
(74) *Attorney, Agent, or Firm*—Foley & Lardner LLP

(57) ABSTRACT

An exhaust gas purifying system for an automotive internal combustion engine. The exhaust gas purifying system comprises a flow-through monolithic catalyst disposed in an exhaust gas passageway through which exhaust gas flows. The monolithic catalyst functions to adsorb and oxidize a soluble organic fraction in exhaust gas, to adsorb nitrogen oxides in exhaust gas in a condition in which a temperature of exhaust gas is not higher than 200° C. and to allow carbon particle in exhaust gas to pass through the monolithic catalyst. Additionally, a filter catalyst is disposed in the exhaust gas passageway downstream of the flow-through monolithic catalyst. The filter catalyst functions to trap the carbon particle and to oxidize hydrocarbons, carbon monoxide and nitrogen monoxide in exhaust gas.

29 Claims, 3 Drawing Sheets

(EXAMPLES 1-12)

OTHER PUBLICATIONS

HONEYCERAM®. NGK Insulators, Ltd., http://www.ngk-.co.jp/english/products/ceramic/c_01.htm. Jul. 18, 2001.

Brunauer et al., "Adsorption of Gases in Multimolecular Layers," J. Am. Chem. Soc., vol. 60, pp. 309–319 (Feb. 1938).

Barrett et al., "The Determination of Pore Volume and Area Distributions in Porous Substrances. I. Computations from Nitrogen Isotherms," J. Am. Chem. Soc., vol. 73, pp. 373–381 (Jan. 1951).

* cited by examiner (EXAMPLES 1-12)

(EXAMPLE 13)

(EXAMPLE 14)

(EXAMPLE 15)

(EXAMPLE 16)

EXHAUST GAS PURIFYING SYSTEM AND METHOD

BACKGROUND OF INVENTION

This invention relates to improvements in exhaust gas purifying system and method, and more particularly to the exhaust gas purifying system and method for removing five noxious components, NOx, HC, CO and PM (including SOF and soot) in exhaust gas such as one discharged from a diesel engine, at high efficiencies.

In recent years, lean-burn engines which are mainly operated on air-fuel mixture having air-fuel ratios richer than a stoichiometric value have been spread from the view points of improving fuel economy and reducing an amount of emission of carbon dioxide. Attention on the lean-burn engines have been paid particularly for diesel engines because of a high fuel economy characteristics in the lean-burn engines. However, exhaust gas of the diesel engines (referred to as "diesel exhaust gas") is high in oxygen content as compared with conventional gasoline-fueled engines which are operated on air/fuel mixtures having air/fuel ratios around the stoichiometric value, so that purification of nitrogen oxides (NOx) becomes insufficient in case of using a conventional three-way catalyst. Further, the diesel engines are low 50 to 100° C. in exhaust gas temperature as compared with the gasoline-fueled engines. In addition, exhaust gas of the diesel engines contains also particulate matter (PM), and therefore is difficult to be purified by using exhaust gas purifying catalysts of the conventional structures. Furthermore, in recent years, fuel economy improvements have been accomplished providing such a tendency that temperatures of exhaust gas of the diesel engines are further lowered so that discharging exhaust gas having temperatures not higher than 200° C. frequently occurs.

Under such circumstances, it has been desired to develop a catalyst for removing noxious components contained in exhaust gas from the diesel engines at high efficiencies. As exhaust gas purifying catalysts for diesel engines, oxidizing catalysts have been conventionally used in which platinum is carried on an inorganic substrate such as alumna or the like. However, although the oxidizing catalysts mainly function to oxidize or remove carbon monoxide (CO) and hydrocarbons (HC) and may oxidize or remove soluble organic fraction (SOF) in the particulate matter to some extent, oxidation or removal of carbon particle (dry soot) as solid particle cannot be effectively accomplished. Additionally, it has been pointed out that when the carried amount of platinum (Pt) serving as an active catalyst component in the exhaust gas purifying catalyst is increased in order to improve an oxidizing effect of the exhaust gas purifying catalyst particularly under low temperature conditions of not higher than 200° C., a large amount of sulfate is produced upon an increase in exhaust gas temperature, which is disadvantageous.

In order to suppress the baneful influence of sulfate and effectively remove the noxious components, it has been proposed to use a catalyst includes a substrate formed of titania to which S component hardly adheres, and a noble metal carried on the substrate, as disclosed in "TOYOTA Technical Review Vol. 47, No. 2, pages 108 to 113 (November 1997) and Japanese Patent Provisional Publication No. 10-180096, which also show the effectiveness of addition of zeolite carrying Pt. In such a conventional proposition, it is pointed out that Pt/zeolite adsorbs SOF and reforms SOF even at relatively low temperatures such as around 150° C., thereby improving the combustibility of SOF. However, in the conventional proposition, evaluation of the catalyst is carried out by using n-hexadecane as an imitation component for SOF, and therefore evaluation of the catalyst on actual gas containing high boiling point components having 20 or more in number of C is not accomplished while combustibility of dry soot (carbon) is not apparent. Accordingly, the effectiveness of the catalyst in the conventional proposition is not apparent in case of being used in a low exhaust gas temperature range of not higher than 200° C. for a long time. Additionally, in the above Review, although the reducing (removing) efficiency to NOx is confirmed during a vehicle cruising mode, the confirmed reducing efficiency is not necessarily sufficient. It will be understood that it is desired to remove at a high efficiency NOx, CO (carbon monoxide), HC (hydrocarbons) and PM in order to accomplish purification of diesel exhaust gas at a high efficiency.

To remove PM, it is essential to apply a filtering technique, and therefore using a porous sintered body or fibrous filter formed of cordierite or silicon carbide has been proposed. It has been also proposed that the fibrous filter is formed of a variety of materials such as alumina and silica. In this connection, a diesel particulate filter (DPF) formed of silicon carbide fiber was proposed in previously printed matters of a scientific lecture in Society of Automotive Engineers of Japan No. 103-98 (an autumn meeting in 1998). However, this fibrous filter is required to be provided with a heater for thermally removing PM trapped on the fibrous filter for the purpose of regenerating the fibrous filter. Thus, this proposition requires a complicated system and therefore is difficult to be applied to small-sized automotive vehicles.

As a method of regenerating the filter without using the heater, the following method has been proposed: A catalyst containing Pt as a main catalyst component is disposed upstream of a filter formed of a ceramic, in which NO in exhaust gas is converted into $NO_2$ having a strong oxidizing ability, followed by combusting PM trapped on the filter under the strong oxidizing ability of $NO_2$. Such a proposition is disclosed in Japanese Patent Provisional Publication No. 1-318715; J. P. Warren et al., "Effects on after-treatment on particulate matter when using the Continuously Regenerating Trap", ImechE 1998 S491/006; and B. Carberry et al., "A focus on current and future particle after-treatment systems", ImechE 1998 S491/007. This method uses reactions among components contained in exhaust gas thereby to continuously combust PM trapped on the filter, and therefore is called a continuously regenerating trap. However, in the present status, there exist limitations for applying the above method, so that a range within the limitations is relatively narrow. For example, a temperature range in which conversion of NO into $NO_2$ can be made is so limited as to be difficult to occur in a temperature condition of not higher than 200° C. Additionally, it is difficult to obtain a necessary amount of $NO_2$ to be required for combustion of PM, while the problem of poisoning with S in exhaust gas may arise.

In addition, a method of combusting and removing PM trapped on a filter under an intermittent thermal control has been proposed in Japanese Patent Provisional Publication No. 7-189656, in which incombustible PM and combustible PM are separately trapped so as to improve the efficiency of regeneration of the filter upon combustion. However, this method requires to changeover the flow direction of exhaust gas in accordance with operating conditions of an internal combustion engine, which is complicated. In this method, combustion heat generated at an upstream trap for the combustible PM (rich in SOF) is supplied to a downstream trap for the incombustible PM (rich in dry soot) so that the supplied heat is used for regeneration of the downstream trap. The upstream trap for combustible PM serves similarly as a catalyst for the purpose of accomplishing warming-up, as disposed in Japanese Patent Provisional Publication No. 61-112716. In other words, the above method in Japanese Patent Provisional Publication No. 7-189656 uses an oxidizing catalyst similarly to conventional methods; however, the conventional methods are not provided with a measure for preferentially combusting SOF in an oxidizing catalyst, and additionally no consideration is taken on adhesion of soot so that it is not apparent as to whether the oxidizing catalyst is durable or not in a low exhaust gas temperature condition and in use for a long time.

Further, in case of using a complicated system for raising an exhaust gas temperature under controlling a throttle valve of an internal combustion engine, with the above method, the following problems will arise: First, it is unclear as to whether heat generation in the upstream trap having the function of an oxidizing catalyst can supply a sufficient quantity of heat to completely combust incombustible PM on the downstream trap. Second, there are apprehensions of occurrence of a thermal deterioration of catalyst components, and of disadvantages due to control of the throttle valve. Additionally, it is not apparent as to whether the traps is endurable or not to use for a long time.

Similarly, Japanese Patent Provisional Publication No. 8-312331 discloses a method using an upstream oxidizing catalyst and a downstream filter, in which light oil or fuel is supplied to and burnt at the upstream oxidizing catalyst so as to raise an exhaust gas temperature, followed by combusting soot on the downstream filter under the effect of high temperature exhaust gas from the upstream oxidizing catalyst. Also in this case, there are apprehensions of thermal deterioration of catalyst components and fuel economy degradation due to supply of fuel.

For the purposes other than exhaust gas purification of automotive vehicles, a fibrous filter on which a variety of catalyst components, zeolite and the like are carried has been proposed in Japanese Patent Provisional Publication No. 11-290624. More specifically, the fibrous filter includes two or more fibrous layers which are laminated to form a filter material. Functional agents such as silicon oxide, activated carbon, zeolite, clay and the like are carried in the filter material. The functional agents are powder-like and contained in the filter material, and has an average particle size larger than the average pore size of the fibrous layer of the filter material. The filter material is formed of polypropylene so as to exhibit a removal performance of ammonia gas. However, no consideration is taken on removal of particle such as particulate matter discharged from an automotive vehicle engine and on a continuous regeneration of the filter. Additionally, heat resistance, particulate trapping and combustion characteristics of the filter are unclear.

Japanese Patent Provisional Publication No. 10-290921 discloses a deodorizing catalytic filter which includes a corrugated fibrous ceramic sheet on which zeolite, manganese (Mn), copper (Cu), platinum (Pt), palladium (Pd), silver (Ag) and the like are carried. However, no consideration is taken on removable of particles and on a continuous regeneration of the filter. Additionally, applicability of the filter to exhaust gas of an automotive vehicle engine is unclear.

SUMMARY OF THE INVENTION

As discussed above, removal of NOx is difficult in the conditions of diesel exhaust gas in which discharging exhaust gas at temperatures not higher than 200° C. frequently occurs. Additionally, oxidizing removal of HC and CO is insufficient in the above conventional oxidizing catalysts. Furthermore, in case of using the filter or the filter in combination with the catalyst components, the complicated system including the device for accomplish the throttle valve control in the internal combustion engine or the heater is required. Even in case of using the continuously regenerating trap in combination with the oxidizing catalyst, combustion reaction for PM is not possible over all vehicle cruising mode conditions. Particularly in the low exhaust gas temperature condition of not higher than 200° C., PM cannot be combusted so that the filter will be clogged with PM. Moreover, a variety of techniques for removing each of NOx, HC, CO and PM (including SOF and soot) have been proposed; however, a so-called five-way exhaust gas purifying system for simultaneously removing the above five noxious components at high efficiencies has not yet been put into practical use.

It is an object of the present invention to provide an improved exhaust gas purifying system and method which overcome drawbacks encountered in conventional exhaust gas purifying systems and methods.

Another object of the present invention is to provide an improved exhaust gas purifying system and method which can simultaneously remove five noxious components, NOx, HC, CO and PM (including SOF and soot) in exhaust gas, respectively at high efficiencies for a long time, under exhaust gas conditions in which low exhaust gas temperatures of not higher than 200° C. frequently occur.

A further object of the present invention is to provide an improved exhaust gas purifying system and method by which $NO_2$ existing in a limited amount in exhaust gas can be effectively used for combusting and removing dry soot upon separating SOF and dry soot in exhaust gas from each other and by treating separately SOF and dry soot.

An aspect of the present invention resides in an exhaust gas purifying system comprising a flow-through monolithic catalyst disposed in an exhaust gas passageway through which exhaust gas flows. The monolithic catalyst functions to adsorb and oxidize a soluble organic fraction in exhaust gas, to adsorb nitrogen oxides in exhaust gas in a condition in which a temperature of exhaust gas is not higher than 200° C. and to allow carbon particle in exhaust gas to pass through the monolithic catalyst. Additionally, a filter catalyst is disposed in the exhaust gas passageway downstream of the flow-through monolithic catalyst. The filter catalyst functions to trap the carbon particle and to oxidize hydrocarbons, carbon monoxide and nitrogen monoxide in exhaust gas.

Another aspect of the present invention resides in a flow-through monolithic catalyst for use in an exhaust gas purifying system, comprising a first section functioning to adsorb and oxidize a soluble organic fraction in exhaust gas. A second section is provided functioning to adsorb nitrogen oxides in exhaust gas in a condition in which a temperature of exhaust gas is not higher than 200° C. A third section is provided functioning to allow carbon particle in exhaust gas to pass through the monolithic catalyst.

A further aspect of the present invention resides in a filter catalyst for use in an exhaust gas purifying system, comprising a first section functioning to trap the carbon particle in exhaust gas. A second section is provided functioning to oxidize hydrocarbons, carbon monoxide and nitrogen monoxide in exhaust gas.

A still further aspect of the present invention resides in an exhaust gas purifying system comprising a flow-through monolithic catalyst disposed in an exhaust gas passageway through which exhaust gas flows. The monolithic catalyst includes means for adsorbing and oxidizing a soluble organic fraction in exhaust gas, means for adsorbing nitrogen oxides in exhaust gas in a condition in which a temperature of exhaust gas is not higher than 200° C., and means for allowing carbon particle in exhaust gas to pass through the monolithic catalyst. Additionally, a filter catalyst is disposed in the exhaust gas passageway downstream of the flow-through monolithic catalyst. The filter catalyst includes means for trapping the carbon particle, and means for oxidizing hydrocarbons, carbon monoxide and nitrogen monoxide in exhaust gas.

A still further aspect of the present invention resides in a method of purifying exhaust gas flowing through an exhaust gas passageway. The method comprises a first process accomplished in a flow-through monolithic catalyst disposed in the exhaust gas passageway, including (a) adsorbing and oxidizing a soluble organic fraction in exhaust gas, (b) adsorbing nitrogen oxides in exhaust gas in a condition in which a temperature of exhaust gas is not higher than 200° C., (c) allowing carbon particle in exhaust gas to pass through the monolithic catalyst; and a second process accomplished in a filter catalyst disposed in the exhaust passageway downstream of the flow-through monolithic catalyst, including (d) trapping the carbon particle in exhaust gas, and (e) oxidizing hydrocarbons, carbon monoxide and nitrogen monoxide in exhaust gas.

DETAILED DESCRIPTION OF THE INVENTION

Figure 6:
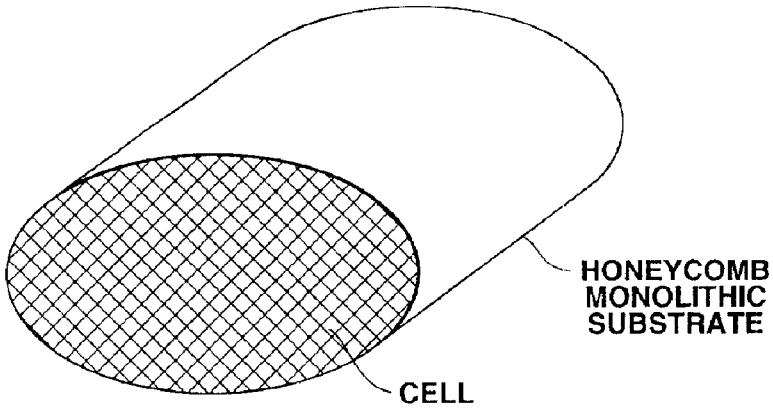
FIG. 6 is a perspective view of an example of a honeycomb monolithic catalyst used in the embodiments of the exhaust gas purifying system according to the present invention.

According to the present invention, an exhaust gas purifying system comprises a flow-through monolithic catalyst disposed in an exhaust gas passageway through which exhaust gas flows. The monolithic catalyst functions to adsorb and oxidize a soluble organic fraction in exhaust gas, to adsorb nitrogen oxides in exhaust gas in a condition in which a temperature of exhaust gas is not higher than 200° C. and to allow carbon particle in exhaust gas to pass through the monolithic catalyst. Additionally, a filter catalyst is disposed in the exhaust gas passageway downstream of the flow-through monolithic catalyst. The filter catalyst functions to trap the carbon particle and to oxidize hydrocarbons, carbon monoxide and nitrogen monoxide in exhaust gas. The flow-through monolithic catalyst means a monolithic catalyst having a plurality of gas flow passages (through which gas flows) extending from its gas inlet face (upstream side) to its gas outlet face (downstream side). A typical example of the flow-through monolithic catalyst is a honeycomb (monolithic) catalyst which includes a honeycomb (monolithic) substrate as shown in FIG. 6 which has many cells which extend throughout the length thereof. Each cell is defined by four flat axially extending walls. A major part of each cell will serve as a gas passage through which exhaust gas flows, after completion of the monolithic catalyst.

The principle of the exhaust gas purifying system according to the present invention has been derived from the present inventor's finding that $NO_2$ existing in a limited amount in exhaust gas can be effectively used for combusting and removing dry soot by separating SOF (soluble organic fraction) and dry soot in exhaust gas from each other and by treating separately SOF and dry soot. It will be understood that SOF is soluble in organic solvent such as dichloromethane.

It will be understood that a filter has been conventionally essential to treat PM in diesel exhaust gas, in which it is advantageous to utilize $NO_2$ having a strong oxidizing action in order to regenerate the filter or to treat PM trapped by the filter. PM includes SOF, S and dry soot, in which $NO_2$ in exhaust gas tends to readily react with SOF so that SOF is preferentially oxidized, followed by $NO_2$ returning to NO. As a result, dry soot which is incombustible as compared with SOF remains not-oxidized. In other words, in order to combust dry soot, it is important to utilize as an oxidizing agent $NO_2$ which has a strong oxidizing action.

In a conventional filter catalyst, a variety of reactions occur during purification of exhaust gas, in which SOF and dry soot are oxidized and removed according to the following reactions represented by equations Eq. (1) to Eq. (3):

$$C \xrightarrow{NO_2} CO_2 + NO \quad \text{Eq. (1)}$$

$$SOF(HC') \xrightarrow{NO_2} CO_2 + H_2O + NO \quad \text{Eq. (2)}$$

$$SOF(HC') \xrightarrow{O_2} CO_2 + H_2O \quad \text{Eq. (3)}$$

In the above reactions of Eqs. (1) and (2), $NO_2$ is consumed. In the above reaction of Eq. (3), $O_2$ is consumed. The reaction of Eq. (2) is predominant in the reactions of Eqs. (2) and (3). Accordingly, $NO_2$ is unavoidably preferentially consumed in the reaction of Eq. (2) so that the amount of $NO_2$ is reduced. As a result, the reaction of Eq. (1) cannot be sufficiently made, and therefore C remains unburned thereby clogging the pores of a filter (section) of the filter catalyst. It will be understood that HC' means unburnt hydrocarbons in exhaust gas.

According to the exhaust gas purifying system of the present invention, SOF and dry soot are separated from each other thereby suppressing occurrence of the reaction of Eq. (2), in which SOF is oxidized and removed mainly by $O_2$ according to the reaction of Eq. (3). This can suppresses consumption of $NO_2$ so that $NO_2$ can be effectively utilized for combustion of dry soot in the reaction of Eq. (1), thereby effectively utilizing $NO_2$ which is limited in amount in exhaust gas.

Therefore, the exhaust gas purifying system of the present invention comprises, a section (i.e., the flow-through monolithic catalyst) for oxidizing SOF and a section (i.e., the filter catalyst) for combusting dry soot, in which SOF and dry soot co-existing in a mixed state in exhaust gas are separated from each other and treated separately. In other words, SOF which is combustible as compared with dry soot is combusted in an upstream side catalyst (or the flow-through monolithic catalyst), while dry soot is trapped and combusted in a downstream side catalyst (or the filter catalyst) having a filtering function. Thus, the exhaust gas purifying system of the present invention is similar to conventional so-called continuously regenerating trap and intermittently combusting trap in such a point that different kinds of catalysts are disposed respectively at the upstream side and downstream side in the exhaust gas passageway.

However, the exhaust gas purifying system of the present invention is quite different from the conventional techniques in such a point that the flow-through monolithic catalyst selectively separates SOF so as to selectively oxidize and remove SOF in exhaust gas. The flow-through monolithic catalyst has pores advantageous for adsorbing SOF in exhaust gas, so that SOF is adsorbed in the monolithic catalyst whereas dry soot cannot be adsorbed and passes through the monolithic catalyst. The dry soot passed through the monolithic catalyst is flown into the filter catalyst so as to be trapped by the filter catalyst. Accordingly, dry soot is prevented from being accumulated on the flow-through monolithic catalyst, so that adsorbed SOF can be selectively oxidized and removed in the flow-through monolithic catalyst.

In order to prevent dry soot from being accumulated on the flow-through monolithic catalyst, it is preferable to prevent pores having around 10 $\mu$m from being formed in a catalytic layer of the flow-through monolithic catalyst, and to use a flow-through substrate having a relatively large hole area rate (or a rate of area of holes or openings serving as gas passages through which exhaust gas flows).

The flow-through monolithic catalyst may not have an ability for converting NO into $NO_2$. During oxidation of SOF in the flow-through monolithic catalyst, SOF is oxidized and removed by $O_2$ serving as an oxidizing agent, suppressing consumption of $NO_2$ as much as possible, upon which $NO_2$ is utilized as an oxidizing agent to treat or oxidize dry soot in the filter catalyst. Thus, according to the exhaust gas purifying system of the present invention, dry soot which is difficult to be combusted can be effectively combusted thereby maintaining a filtering function of the filter catalyst.

The flow-through monolithic catalyst is preferably the honeycomb catalyst which includes a catalytic layer. The catalytic layer includes a porous carrier (or SOF trapping or adsorbing material) on which a catalyst component or metal is carried. The porous carrier is formed of a refractory inorganic oxide (meso-porous material) which has preferably an average pore size ranging from 1 to 10 nm, and more preferably an average pore size ranging from 1 to 4 nm. The average pore size is measured by a so-called B. J. H method (J. Am. Chem. Soc., 73, 373 (1951). The refractory inorganic oxide contains or carries Pt. The refractory inorganic oxide preferably includes oxide(s) of metal(s) such as silicon (Si), aluminum (Al), titan (Ti) and/or zirconium (Zr). Such refractory inorganic oxide forming the porous carrier is used not only for the flow-through monolithic catalyst but also for the filter catalyst. The average pore size of the refractory inorganic oxide within the range of from 1 to 10 nm is advantageous to trap SOF and contributes to preferentially oxidize SOF on the catalyst.

In case that Pt is well dispersed in the catalytic layer of the catalyst, SOF can be effectively oxidized. In order to well disperse Pt, a high surface area material having a specific surface area of not lower than 250 $m^2/g$ is preferably used in the catalytic layer. The specific surface area was measured by a so-called BET method (J. Am. Chem. Soc. 60, 309 (1938). An example of the high surface area material is a so-called meso-porous material. Further examples of the high surface area material are clay mineral and zeolite which have an average pore size ranging from 1 to 10 nm and suitable for well dispersing Pt in the catalytic layer. Concerning layered clay mineral belonging to the clay mineral, it is effective to use that having a swelling property since the layered clay mineral has a two dimensional structure. As the clay mineral having the swelling property, smectite clay mineral such as montmorillonite and hectorite is preferably used. As the zeolite, MFI, zeolite β, mordenite, USY zeolite and/or ferrielite are preferably used.

In the catalytic layer, the smectite clay mineral and/or the zeolite are used, or otherwise a plurality of the smectite clay minerals and/or a plurality of the zeolites are used. In order to form meso-pores (mesoscopic pores) effective for trap SOF, the smectite clay mineral(s) and the zeolite(s) are preferable to be used upon being mixed.

It is preferable the flow-through monolithic catalyst and the filter catalyst contains cerium (Ce), lanthanum (La), zirconium (Zr), iron (Fe), magnesium (Mg) and/or potassium (K). This allows the catalysts to adsorb NOx even when exhaust gas is in a low temperature condition of not higher than 200° C., thereby effectively combusting PM including SOF, dry soot and the like. For example, the catalysts temporarily trap or store thereon NOx emitted in a cold condition or during engine starting. The thus trapped $NO_2$ is released from the surface of the catalysts when the temperature of exhaust gas rises to a level at which reaction between $NO_2$ and dry soot initiates, thereby effectively combusting dry soot.

In addition, it is preferable to divide the flow-through monolithic catalyst into two sections. One of the two sections serves as a SOF adsorbing and oxidizing section for adsorbing and oxidizing soluble organic fraction (SOF) in exhaust gas, while the other serves as a NOx adsorbing section for adsorbing nitrogen oxides when the temperature of exhaust gas is not higher than 200° C., in which the SOF adsorbing and oxidizing section is preferably disposed upstream of the NOx adsorbing section so as to achieve a further high purification efficiency of exhaust gas. The NOx adsorbing section contains a NOx adsorbing or trapping material (catalyst) as disclosed in Japanese Patent No. 2600492. which functions to adsorb or trap NOx. More specifically, it is effective that the NOx adsorbing section is prevented from contacting SOF in a relatively low temperature condition of not higher than 200° C. because SOF can unavoidably cover the surface of the catalytic layer of the NOx adsorbing section. It is also effective to dispose the SOF adsorbing and oxidizing section provided with the material for effectively adsorbing SOF, upstream of the NOx adsorbing section.

In the exhaust gas purifying system of the present invention including a catalyst arrangement, a temperature of exhaust gas and an amount of a reducing agent in exhaust gas are controlled by changing an air/fuel ratio (A/F) of exhaust gas at an exhaust outlet of the internal combustion engine, thereby particularly improving reduction or removal of NOx. Specifically, it is preferable to provide a hydrogen ratio control device or means for controlling a rate (volume) of hydrogen relative to all reducing components (i.e., a ratio of [hydrogen/all reducing components]) in exhaust gas, at values of not lower than 0.5 at a location upstream of the NOx adsorbing section, when the A/F of exhaust gas is smaller (richer) than 14. This can accomplish exhaust gas purification at a very high efficiency.

In a diesel engine equipped with a so-called common rail fuel injection system, controlling A/F of exhaust gas is accomplished by controlling a fuel injection amount (amount of fuel injected from a fuel injector), a fuel injection timing (timing at which fuel is injected from the fuel injector), a fuel injection pressure (pressure at which fuel injected from the fuel injector), and an intake air amount (amount of intake air to be sucked into the engine).

In order to promote purification of exhaust gas in a low exhaust gas temperature condition of not higher than 200° C., it is preferable to control the rate (volume) of hydrogen relative to all reducing components (or the ratio of [hydrogen/all reducing components]) at values of not smaller than 0.5 at the location upstream of the NOx adsorbing section, when the A/F of exhaust gas is smaller (richer) than 14. More specifically, in such a low exhaust gas temperature condition, HC and CO are preferentially adsorbed on the catalyst over accomplishing reduction for adsorbed NOx, so that a sufficient NOx reduction rate may not be obtained. However, $H_2$ is high in reducing ability so as to effectively act as a reducing agent for NOx. This makes it possible to effectively purifying exhaust gas, maintaining the concentration of $H_2$ and lowering the concentration of CO and HC. If the rate of hydrogen relative to all reducing components is smaller than 0.5, adsorption of HC and CO) becomes predominant, and therefore a sufficient NOx reducing rate cannot be obtained.

Realizing the above ratio of [hydrogen/all reducing components] is accomplished by controlling combustion in the engine and/or disposing a particular catalyst at the upstream side (in the exhaust gas passageway) of the NOx adsorbing material which can adsorb or trap NOx. Specifically, it is preferable to dispose a hydrogen supplying catalyst (serving as a hydrogen/all reducing components ratio control device or means) in the exhaust gas passageway upstream of the NOx adsorbing section. The hydrogen $H_2$) supplying catalyst contains at least one of noble metals including platinum (Pt), palladium (Pd) and/or rhodium (Rh), and cerium (Ce). This hydrogen supply catalyst can selectively remove CO and HC in exhaust gas. Such mechanism is not clear at the present stage; however, the present inventors have found that the hydrogen supplying catalyst selectively oxidizes only CO and HC while H2 is hardly consumed. It is preferable to cause 60% by weight or more of the above noble metal(s) to be carried on Ce, which is assumed to exhibit remarkable effects for the hydrogen supplying catalyst. It will be understood that the catalyst components (the noble metals and cerium) of the hydrogen supplying catalyst may be carried on the monolithic honeycomb substrate of the above SOF adsorbing and oxidizing section.

The filter catalyst disposed downstream of the flow-through monolithic catalyst is formed by carrying the catalyst components including Pt on a filter, or by causing the filter to include a fibrous refractory inorganic compound which contains or carries Pt. On this filter catalyst, combustion of dry soot trapped on the filter can be effectively promoted thereby achieving a high regeneration effect for the filter catalyst. In the filer catalyst, an oxidation reaction of NO represented by Eq. (4) and the oxidation reaction of dry soot by $NO_2$ represented by Eq. (1) are repeatedly carried out thereby effectively utilizing $NO_2$ as the oxidizing agent thus effectively oxidizing and removing dry soot.

$$NO \rightarrow NO_2 \qquad \text{Eq. (4)}$$

It will be understood that the filter catalyst contains Pt as a catalytic component and therefore can remove other exhaust gas noxious components such as HC, CO and NO.

The filter catalyst preferably contains at least one of metals such as Ce and La, and/or at least one oxide of metals such as Si and Al. The oxide of metals preferably has an average particle size of not larger than 0.05 $\mu$m, and carries Pt. Pt is preferably carried on the oxide of metals, for example, by coating the filter with the oxide in the form of ultra fine powder having an average particle size of not larger than 0.05 $\mu$m, followed by impregnating the coated filter with an aqueous solution of Pt. It is not preferable to use the oxide of metals having a large average particle size because the oxide is coated on the outer surface of the filter so as to block the pores of the filter thereby lowering a trapping amount of PM and increasing a pressure loss of the filter. The average particle size was measured by a laser diffraction scattering method using a light source of semiconductor laser having a wavelength of 680 nm and an output power of 3 mW.

In case that at least one of the metals such as Ce and La, and/or at least one oxide of the metals such as Si and Al are used in combination with Pt in the filter catalyst, PM accumulated on the filter catalyst can be effectively combusted and removed. That is, PM are trapped in a dispersed state on Pt and the metals and/or the metal oxides, in which PM can be oxidized at a contacting point with Pt component even at a relatively low temperature condition of about 300° C. under a so-called catalytic combustion effect. Further, particularly in case that the concentration of the reducing components in exhaust gas increases or that a control for increasing exhaust gas temperature is carried out during changing in air-fuel ratio (A/F) in exhaust gas, combustion of PM can be spread and promoted under the catalytic combustion effect serving as a nucleus for combustion of PM, thus accomplishing regeneration of the filter catalyst.

The filter catalyst includes a filter on or in which catalyst components are carried. Examples of the filter are a so-called checkered honeycomb filter, and a fibrous filter. The checkered honeycomb filter is formed by partly blocking a plurality of axially extending openings of a honeycomb monolithic structure (substrate) at its opposite ends, the monolith structure being formed of SiC or cordierite. The checkered honeycomb filter means a wall flow filter including a cellular monolith, modified by blocking alternate cells, in chess-board fashion, on the entrance face, the exit face being similarly blocked, so that exhaust gas is forced through the porous walls to exit through an adjacent cell (as disclosed in "Introduction to Internal Combustion Engines" Pages 598 to 600 and FIG. 62, written by Richard Stone and published by Society of Automotive Engineers, Inc.). The fibrous filter is produced by forming a woven fabric or a non-woven fabric using fibrous refractory inorganic compound, followed by forming the fabric into a cylindrical shape or a bellows shape.

It will be understood that a filter formed of sintered ceramic such as cordierite, mullite or SiC or formed of metal foam is not preferable because it tends to be clogged. Accordingly, in order to use the filter formed of the sintered ceramic, it is preferable to causing the above-mentioned oxide in the form of ultra fine powder is sufficiently dispersed and carried in the pores of the filter, in which it is preferable to prevent air bubbles in the pores under vacuum suction.

The filter catalyst preferably includes the filter formed of fiber, and more preferably includes the filter formed of ceramic fiber. The filter catalyst including the fiber filter is advantageous because of being low in pressure drop characteristics, high in trapping efficiency for PM, large in contacting surface area for exhaust gas, and excellent in ability for dispersively carrying the catalyst components. However, the ceramic checkered honeycomb filter can be also used as the filter of the filter catalyst because it has a relatively large surface area for contacting with exhaust gas, a high trapping efficiency for PM and a low pressure drop characteristics.

In addition, the filter of the filter catalyst may be produced by winding fiber of metal oxide into a coil shape so as to obtain the cylindrical filter, or by weaving the fiber to form a woven fabric, followed by suitably fabricating the woven fiber into a suitable shape. Thus, although a variety of shapes and materials are considered for the filter, they are suitably selectable in accordance with required conditions such as a space for the filter catalyst. It will be understood that the filter catalyst may be used not only for purification of diesel exhaust gas but also for purification of exhaust gas discharged from other internal combustion engine than diesel engines.

It is preferable to dispose a HC adsorbing catalyst in the exhaust gas passageway downstream of the flow-through monolithic catalyst. The HC adsorbing catalyst functions to adsorb hydrocarbons (HC) other than SOF, thereby making it possible to effectively removing HC particularly during engine starting or at so-called cold start. The HC adsorbing catalyst is disposed downstream of the filter catalyst and/or formed in or on the filter catalyst.

The filter catalyst may be divided into two parts or stages which are arranged in series to be located upstream and downstream sides relative to flow of exhaust gas, thereby improving a trapping efficiency for PM. In such a multiple stage filter catalyst, it is preferable that an upstream side stage filter catalyst includes the filter body formed of the fibrous refractory inorganic compound and having a relatively low filtering efficiency, while a downstream side stage filter catalyst includes the filter body formed of the sintered body of the refractory inorganic compound. In the filter catalyst formed by causing the catalyst components to be dispersively carried in the filter formed of the fibrous refractory inorganic compound, PM moves through narrow clearances formed among fibers carrying the catalyst components, pushing aside the fibers, so that chances of contact between PM and the catalyst components increase thereby promoting removal of PM.

In order to use the exhaust gas purifying system of the present invention for a long time, it is preferable to carry out a so-called regeneration treatment for combusting and removing PM accumulated in or on the filter, and a so-called sulfur releasing treatment for releasing sulfur accumulated the NOx adsorbing material for adsorbing or trapping NOx so as to prevent the NOx adsorbing material from deteriorating, the sulfur being from fuel. In view of this, in the exhaust gas purifying system of the present invention, it is preferable that the air/fuel ratio (A/F) of exhaust gas at the location near the exhaust outlet (through which exhaust gas is discharged) of the internal combustion engine is changed during operation of the engine. It is preferable to control the air/fuel ratio of exhaust gas and the [hydrogen/all reducing components] ratio at the location upstream of the NOx adsorbing section of the flow-through monolithic catalyst, and a temperature of exhaust gas of the engine.

Here, the air/fuel ratio (A/F) is preferably controlled to be smaller (richer) than 14.7. This is achieved, for example, in the diesel engine equipped with the common rail fuel injection system, by regulating the intake air amount, the fuel injection timing, an EGR rate (rate of exhaust gas recirculated into the engine relative to intake air), the fuel injection amount, the fuel injection pressure and the like, thereby relatively increasing the concentration of the reducing components such as unburned hydrocarbon, CO and $H_2$ in exhaust gas. When the air/fuel ratio is not smaller (leaner) than 14.7, oxidation of the reducing components such as hydrocarbons, CO and $H_2$ becomes predominant owing to excessively present oxygen, so that an effect for releasing sulfur will be lowered. However, by increasing the concentration of $H_2$ (having a high reducing action) in the reducing components, releasing sulfur from the NOx adsorbing material can be largely facilitated, in which the sulfur-poisoning releasing treatment (or regeneration) can be accomplished even in a temperature condition of around 500° C. In concrete, the hydrogen/all reducing components ratio is controlled to be not smaller than 0.7. If the ratio is smaller than 0.7, the effect for releasing sulfur is insufficient.

For example, controlling the [hydrogen/all reducing components] ratio is accomplished by regulating combustion in the engine or by disposing a particular catalyst in the exhaust gas passageway upstream of the NOx adsorbing or trapping material (catalyst component), the particular catalyst being for regulating the composition of exhaust gas. The particular catalyst is a catalyst as same as the above-discussed hydrogen supply catalyst containing Pt, Pd, Rh, Ce and/or the like, in which the particular catalyst and the hydrogen supply catalyst are assumed to be different in mechanism for relatively increasing $H_2$ concentration in a condition where exhaust gas temperature is not lower than 500° C. In case of the particular catalyst, CO is consumed while $H_2$ is produced under a so-called CO water gas shift reaction made between CO and water in exhaust gas. The above-discussed hydrogen supply catalyst is effective for promoting the CO water gas shift reaction. On the hydrogen supply catalyst, a catalyst combustion reaction of hydrocarbons including SOF is made so as to raise the temperature of exhaust gas. By this, the temperature of the NOx adsorbing material (or the NOx adsorbing section of the flow-through monolithic catalyst), the filter catalyst, and parts around them is raised, so that releasing sulfur from the NOx adsorbing material can be promoted thereby effectively combusting PM accumulated on the filter (or filter catalyst). Thus, combustion of PM accumulated on the filter can be accomplished merely by raising the temperature of the filter as discussed above, followed by returning engine operation into a normal operation mode. During this exhaust gas temperature control, the concentration of oxygen in exhaust gas is raised so that combustion is spread to oxidize and remove PM. Such exhaust gas temperature control is carried out at intervals of consumption of a certain amount of fuel in the engine, or when the pressure loss of the filter (or the filter catalyst) exceeds a certain level upon detecting the pressure loss.

EXAMPLES

The present invention will be more readily understood with reference to the following Examples in comparison with Comparative Examples; however, these Examples are intended to illustrate the invention and are not to be construed to limit the scope of the invention.

Example 1

(1) Production of Flow-through monolithic carrier for combustion of SOF

Porous silica having a specific surface area of about 830 $m^2/g$ and an average pore size of about 3.2 nm was impregnated with an aqueous solution of lanthanum nitrate and an aqueous solution of dinitrodiammine platinum (Pt) having a Pt concentration of about 4% by weight thereby obtaining powdered impregnated porous silica which carried 4.0% by weight of Pt and 1.0% by weight of La. The powdered impregnated silica was mixed with boehmite powder in a weight ratio of 3 (silica):1 (boehmite powder), followed by adding 1% by weight of nitric acid-acidic alumina sol, thereby forming a mixture. The mixture was mixed with water and then pulverized for 60 minutes in a porcelain ball mill pot provided with alumina balls each having a diameter of 7 mm, thus obtaining a slurry.

This slurry was coated on a cordierite ceramic honeycomb monolithic substrate (having the trade name of HONEYCERAM(R), produced by NGK Insulators, Ltd.) having a volume of 1.5 liters and 300 cells per square inch. The cells were formed extending throughout the length of the monolithic substrate so as to serve as gas passages through which exhaust gas flows. The coated monolithic substrate was dried and calcined thereby to form a flow-through monolithic catalyst provided with a coat or catalytic layer having a weight of 75 g per one liter of the monolithic substrate.

(2) Production of Filter catalyst formed of fiber

An aqueous solution of cerium nitrate was mixed with an aqueous solution of dinitrodiammine platinum (Pt) having a Pt concentration of about 4% by weight so as to prepare a mixture aqueous solution. Alumina fine powder having a specific surface area of about 55 $m^2/g$ and an average particle size of about 0.03 $\mu$m was impregnated with the mixture aqueous solution and then dried at 110° C. for 8 hours or more, followed by subjecting to calcining at 500° C. for 2 hours, thereby obtaining Pt/Ce alumina powder containing about 1% by weight of Pt and about 3.5% by weight of Ce relative to the alumina fine powder. Nitric acid-acidic alumina sol in an amount of 1.0% by weight was added to the Pt/Ce alumina powder, followed by mixing with water thereby to form a Pt/Ce alumina powder mixture. The Pt/Ce alumina powder mixture was pulverized for 60 minutes in a porcelain ball mill pot provided with alumina balls each having a diameter of 7 mm thereby obtaining a slurry.

Fiber formed of three components (silica, alumina and boria) was prepared to have an average diameter of about 20 $\mu$m. The above slurry was sprayed on the surface of the fiber so that the fiber was coated with the slurry. Subsequently, the coated fiber was dried and calcined so as to fix catalyst component particles on the fiber. The amount of the catalyst component particles coated on the fiber was 35% by weight relative to the fiber.

The coated fiber was wound coil-shaped thereby to form a cylindrical filter catalyst having an inner diameter of 80 mm, a length of 270 mm and a thickness of about 10 mm.

Figure 1:
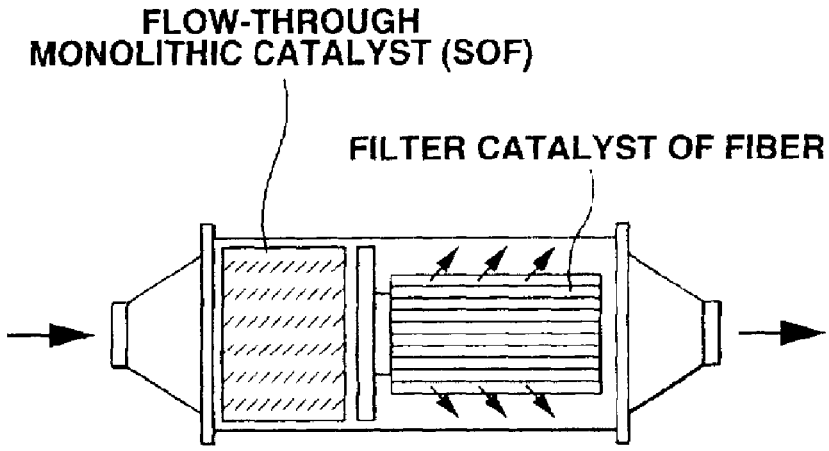
FIG. 1 is a schematic sectional view of an embodiment of an exhaust gas purifying system according to the present invention, relating to Examples 1 to 12.

The thus produced flow-through monolithic catalyst (for combustion of SOF) and the cylindrical filter catalyst were arranged in series and set in a casing as shown in FIG. 1 in which the monolithic catalyst and the filter catalyst were located respectively on upstream and downstream sides relative to flow of exhaust gas, thereby preparing an exhaust gas purifying system 1 of Example 1.

Examples 2 to 5

Flow-through monolithic catalysts for combustion of SOF, of Examples 2 to 5 were produced by repeating the procedure (1) in Example 1 with the exception that aqueous solutions of cerium nitrate, iron nitrate, magnesium nitrate and zirconyl nitrate are respectively used in Examples 2, 3, 4 and 5, in place of the aqueous solution of lanthanum nitrate.

Filter catalysts formed of fiber, of Examples 2 to 5 were produced by repeating the procedure (2) in Example 1.

Each of the thus produced flow-through monolithic catalyst (for combustion of SOF) and each of the thus produced cylindrical filter catalyst were arranged in series and set in a casing as shown in FIG. 1 in which the monolithic catalyst and the filter catalyst were located respectively on upstream and downstream sides relative to flow of exhaust gas, thereby preparing respectively an exhaust gas purifying systems 2, 3, 4 and 5 of Examples 2, 3, 4 and 5.

Examples 6 to 9

Flow-through monolithic catalysts for combustion of SOF, of Examples 6 to 9 were produced by repeating the procedure (1) in Example 1.

Filter catalysts formed of fiber, of Examples 6 to 9 were produced by repeating the procedure (2) in Example 1 with the exception that aqueous solutions of lanthanum nitrate, iron nitrate, magnesium nitrate and potassium nitrate were respectively used in Examples 6, 7, 8 and 9, in place of the aqueous solution of cerium nitrate.

Each of the thus produced flow-through monolithic catalyst (for combustion of SOF) and each of the thus produced cylindrical filter catalyst were arranged in series and set in a casing as shown in FIG. 1 in which the monolithic catalyst and the filter catalyst were located respectively on upstream and downstream sides relative to flow of exhaust gas, thereby preparing respective exhaust gas purifying systems 6, 7, 8 and 9 of Examples 6, 7, 8 and 9.

Examples 10 to 12

Flow-through monolithic catalysts for combustion of SOF, of Examples 10 to 12 were produced by repeating the procedure (1) in Example 1 with the exception that montmorillonite having a specific surface area of about 420 $m^2/g$ and an average pore size of about 5.5 nm, hectorite having a specific surface area of about 280 $m^2/g$ and an average pore size of about 7.8 nm and zeolite $\beta$ having a specific surface area of about 480 $m^2/g$ and an average pore size of about 2.8 nm were respectively used in Examples 10, 11 and 12, in place of the porous silica having a specific surface area of about 830 $m^2/g$ and an average pore size of about 3.2 nm.

Filter catalysts formed of fiber, of Examples 10 to 12 were produced by repeating the procedure (2) in Example 1.

Each of the thus produced flow-through monolithic catalysts (for combustion of SOF) and each of the thus produced cylindrical filter catalysts were arranged in series and set in a casing as shown in FIG. 1 in which the monolithic catalyst and the filter catalyst were located respectively on upstream and downstream sides relative to flow of exhaust gas, thereby preparing respective exhaust gas purifying systems 10, 11 and 12 of Examples 10, 11 and 12.

Example 13

(1) Production of Flow-through monolithic catalyst for adsorbing and oxidizing SOF Porous silica having a specific surface area of about 830 $m^2/g$ and an average pore size of about 3.2 nm was impregnated with an aqueous solution of lanthanum nitrate and an aqueous solution of dinitrodiammine platinum (Pt) having a Pt concentration of about 4% by weight thereby obtaining powdered impregnated porous silica which carried 4.0% by weight of Pt and 1.0% by weight of La. The powdered impregnated silica was mixed with boehmite powder in a weight ratio of 3 (silica):1 (boehmite powder), followed by adding 1% by weight of nitric acid-acidic alumina sol, thereby forming a mixture. The mixture was mixed with water and then pulverized for 60 minutes in a porcelain ball mill pot provided with alumina balls each having a diameter of 7 mm, thus obtaining a slurry.

This slurry was coated on a cordierite ceramic honeycomb monolithic substrate (having the trade name of HONEYCERAM(R), produced by NGK Insulators, Ltd.) having a volume of 0.8 liter and 400 cells per square inch. The cells were formed extending throughout the length of the monolithic substrate so as to serve as gas passages through which exhaust gas flows. The coated monolithic substrate was dried and calcined thereby to form a flow-through monolithic catalyst provided with a coat or catalytic layer having a weight of 100 g per one liter of the monolithic substrate.

(2) Production of Flow-through monolithic catalyst for adsorbing NOx

Activated alumina having a specific surface area of about 220 $m^2/g$ was impregnated with an aqueous solution of lanthanum nitrate, an aqueous solution of dinitrodiammine platinum (Pt) having a Pt concentration of about 4% by weight and an aqueous solution of rhodium nitrate having a Rh concentration of about 3%, thereby obtaining powdered impregnated activated alumina which carried 4.0% by weight of Pt and 0.8% by weight of Rh. The powdered impregnated activated alumina was mixed with boehmite powder in a weight ratio of 3 (silica):1 (boehmite powder), followed by adding 1% by weight of nitric acid-acidic alumina sol, thereby forming a mixture. The mixture was mixed with water and then pulverized for 60 minutes in a porcelain ball mill pot provided with alumina balls each having a diameter of 7 mm, thus obtaining a slurry.

This slurry was coated on a cordierite ceramic honeycomb monolithic substrate (having the trade name of HONEYCERAM(R), produced by NGK Insulators, Ltd.) having a volume of 1.2 liters and 400 cells per square inch. The cells were formed extending throughout the length of the monolithic substrate so as to serve as gas passages through which exhaust gas flows. The coated monolithic substrate was dried and calcined thereby to form a honeycomb monolithic catalyst. The thus formed honeycomb monolithic catalyst was impregnated with a solution of barium acetate, followed by drying and calcining, thus producing a flow-through monolithic catalyst for adsorbing NOx, provided with a coat or catalytic layer (containing the NOx adsorbing material) having a weight of 150 g per one liter of the monolithic substrate.

(3) Production of Filter catalyst of monolithic form

A slurry state aqueous solution was prepared in which alumina fine powder having a specific surface area of about 55 $m^2/g$ and an average particle size of about 0.03 $\mu$m was dispersed. The slurry state aqueous solution was coated on a so-called checkered honeycomb filter having a volume of 1.7 liters and about 300 cells per square inch. The cells were formed extending throughout the length of the filter so as to serve as gas passages through which exhaust gas flows, in which exhaust gas also flows through each wall extending between the adjacent gas passages while being filtered. The thus coated checkered honeycomb filter was subjected to suction under vacuum so that the alumina fine powder was dispersed within pores of the filter, followed by drying and calcining, thereby fixing the alumina fine powder within the pores of the filter.

A mixture aqueous solution was prepared by mixing an aqueous solution of cerium nitrate and an aqueous solution of dinitrodiammine platinum (Pt) having a Pt concentration of about 4% by weight. The above filter was dipped in the mixture solution so that Pt and Ce were adsorbed and carried by the alumina on the walls of the filter, thereby obtaining a monolithic form filter catalyst (or cordierite honeycomb filter catalyst).

Figure 2:
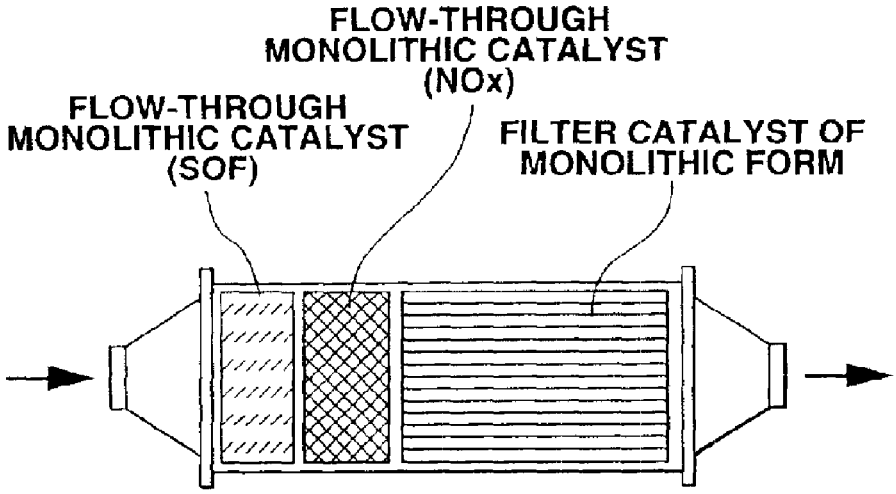
FIG. 2 is a schematic sectional view of another embodiment of the exhaust gas purifying system according to the present invention, relating to Example 13.

The thus produced flow-through monolithic catalyst (having the volume of 0.8 liter) for adsorbing and oxidizing SOF, the flow-through monolithic catalyst (having the volume of 1.2 liters) for adsorbing NOx and the cordierite honeycomb filter catalyst (having the volume of 1.7 liters) were arranged in series and set in a casing as shown in FIG. 2 in which the flow-through monolithic catalyst and the cordierite honeycomb filter catalyst were located respectively on upstream and downstream sides relative to flow of exhaust gas, the flow-through monolithic catalyst being located between them. Thus, an exhaust gas purifying system 13 of Example 13 was prepared.

Example 14

(1) Production of $H_2$ supplying catalyst

Cerium oxide was impregnated with an aqueous solution of dinitrodiammine platinum (Pt) having a Pt concentration of about 4% by weight, followed by drying and calcining, thereby obtaining $Pt/CeO_2$ catalyst powder. The catalyst powder was mixed with activated alumina powder having a specific surface area of about 220 $m^2/g$, activated alumina and boehmite powder, followed by addition of 1% by weight of nitric acid-acidic alumina sol, thereby forming a mixture. This mixture was mixed with water and pulverized for 60 minutes in a porcelain ball mill pot provided with alumina balls each having a diameter of 7 mm, thus obtaining a slurry. The slurry was coated on a cordierite ceramic honeycomb monolithic substrate (having the trade name of HONEYCERAM(R), produced by NGK Insulators, Ltd.) having a volume of 1.0 liter and 600 cells per square inch. The cells were formed extending throughout the length of the monolithic substrate so as to serve as gas passages through which exhaust gas flows. The coated monolithic substrate was dried and calcined thereby to form a $H_2$ supplying catalyst (or flow-through monolithic catalyst) provided with a coat catalytic layer (powder mixture) having a weight of 150 g per one liter of the monolithic substrate.

In the same manner as that in Example 13, alumina fine powder, Pt and Ce were dispersedly carried in the checkered honeycomb filter having a volume of 0.9 liter. This was repeated twice thereby producing two monolithic form filter catalysts (or cordierite honeycomb filter catalysts). The two filter catalysts were arranged in series and set in a downstream side casing as shown in FIG. 2.

Figure 3:
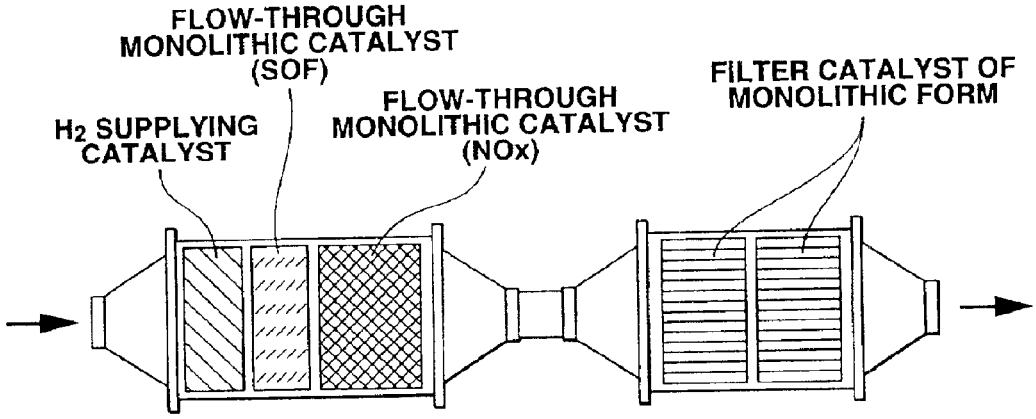
FIG. 3 is a schematic sectional view of a further embodiment of the exhaust gas purifying system according to the present invention, relating to Example 14.

The above $H_2$ supplying catalyst, the flow-through monolithic catalyst for combustion of SOF (in Example 1) and the flow-through monolithic catalyst for adsorbing NOx (in Example 13) were arranged in series and set in a upstream side casing as shown in FIG. 3 in which the $H_2$ supplying catalyst and the monolithic catalyst for adsorbing NOx were located respectively on upstream and downstream sides relative to flow of exhaust gas, the monolithic catalyst for combustion of SOF being located between them. The above downstream side casing was connected to the upstream side casing as shown in FIG. 3, in which the upstream side and downstream side casings were respectively located on upstream and downstream sides relative to flow of exhaust gas. Thus, an exhaust gas purifying system 14 of Example 14 was prepared.

Example 15

(1) Production of $H_2$ supplying and SOF adsorbing-oxidizing catalyst

Cerium oxide was impregnated with an aqueous solution of dinitrodiammine platinum (Pt) having a Pt concentration of about 4% by weight, followed by drying and calcining, thereby obtaining $Pt/CeO_2$ catalyst powder. The catalyst powder was mixed with activated alumina powder having a specific surface area of about 220 $m^2/g$, and boehmite powder, followed by addition of 1% by weight of nitric acid-acidic alumina sol, thereby forming a mixture. This mixture was mixed with water and pulverized for 60 minutes in a porcelain ball mill pot provided with alumina balls each having a diameter of 7 mm, thus obtaining a slurry. The slurry was coated on a cordierite ceramic honeycomb monolithic substrate (having the trade name of HONEYCERAM (R), produced by NGK Insulators, Ltd.) having a volume of 1.5 liters and 600 cells per square inch. The cells were formed extending throughout the length of the monolithic substrate so as to serve as gas passages through which exhaust gas flows. The coated monolithic substrate was dried and calcined thereby to form a flow-through monolithic catalyst provided with a (lower) coat or catalytic layer (powder mixture) having a weight of 100 g per one liter of the monolithic substrate.

Porous silica having a specific surface area of about 830 $m^2/g$ and an average pore size of about 3.2 nm was impregnated with an aqueous solution of lanthanum nitrate and an aqueous solution of dinitrodiammine platinum (Pt) having a Pt concentration of about 4% by weight thereby obtaining powdered impregnated porous silica which carried 4.0% by weight of Pt and 1.0% by weight of La. The powdered impregnated silica was mixed with boehmite powder in a weight ratio of 3 (silica):1 (boehmite powder), followed by adding 1% by weight of nitric acid-acidic alumina sol, thereby forming a mixture. The mixture was mixed with water and then pulverized for 60 minutes in a porcelain ball mill pot provided with alumina balls each having a diameter of 7 mm, thus obtaining a slurry. The slurry was coated on the above flow-through monolithic catalyst (with the coat or catalytic layer), followed by drying and calcining, thereby obtaining a $H_2$ supplying and SOF adsorbing-oxidizing catalyst. The $H_2$ supplying and SOF adsorbing-oxidizing catalyst was provided with a (upper) coat or catalytic layer (powder mixture) having a weight of 100 g per one liter of the monolithic substrate.

Figure 4:
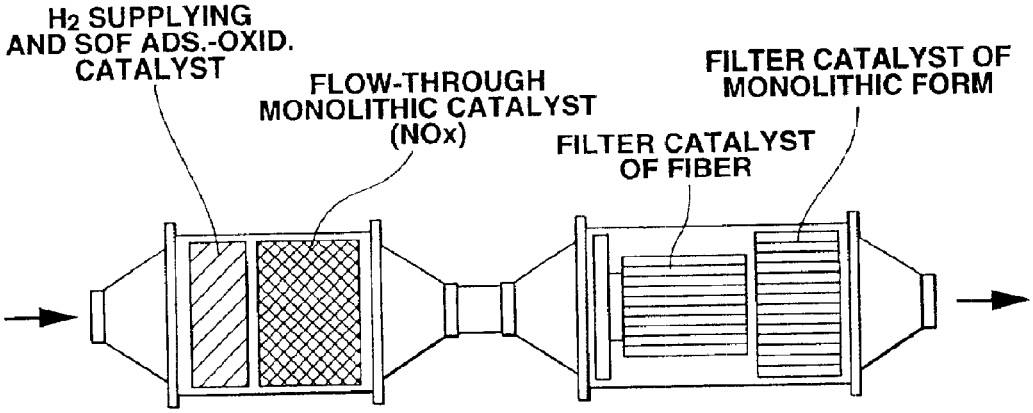
FIG. 4 is a schematic sectional view of a further embodiment of the exhaust gas purifying system according to the present invention, relating to Example 15.
Figure 5:
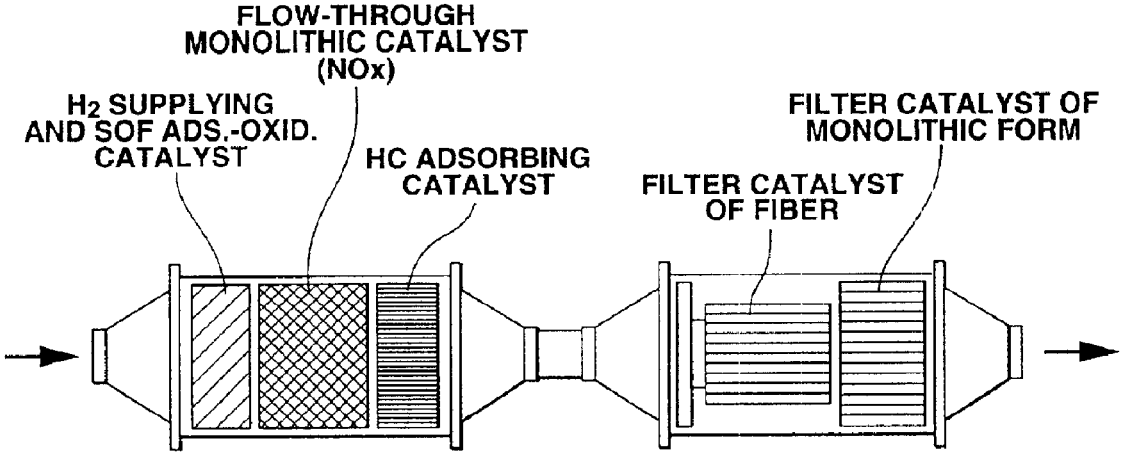
FIG. 5 is a schematic sectional view of a further embodiment of the exhaust gas purifying system according to the present invention, relating to Example 16.

The above $H_2$ supplying and SOF adsorbing-oxidizing catalyst and the flow-through monolithic catalyst for adsorbing NOx (in Example 13) were arranged in series and set in a upstream side casing as shown in FIG. 4 in which $H_2$ supplying and SOF adsorbing-oxidizing catalyst were located respectively on upstream and downstream sides relative to flow of exhaust gas. Additionally, the catalyst formed of fiber (in Example 1) and one of the monolithic form filter catalysts (or cordierite honeycomb filter catalysts) (in Example 14) having the volume of 0.9 liter were arranged in series and set in a casing a downstream side casing as shown in FIG. 4 in which the catalyst formed of fiber and the monolithic form filter catalyst were located respectively on upstream and downstream sides relative to flow of exhaust gas. The above downstream side casing was connected to the upstream side casing as shown in FIG. 4, in which the upstream side and downstream side casings were respectively located on upstream and downstream sides relative to flow of exhaust gas. Thus, an exhaust gas purifying system 15 of Example 15 was prepared.

Example 16

An exhaust gas purifying system of Example 16 was prepared by repeating the procedure in Example 15 with the exception that a HC adsorbing catalyst was disposed in series with the $H_2$ supplying and SOF adsorbing-oxidizing catalyst and the flow-through monolithic catalyst for adsorbing NOx and located downstream of the flow-through monolithic catalyst. The three catalysts were disposed in the upstream side casing.

The HC adsorbing catalyst was produced as follows:

Zeolite having a silica/alumina ratio of about 45, acidic silica sol having a silica content of about 20% by weight and water were mixed and supplied into a porcelain ball mill pot provided with alumina balls each having a diameter of 5 mm, followed by pulverization for 60 minutes, thereby obtaining a zeolite containing slurry which has a weight ratio of zeolite:silica=7.5:2.5.

Activated alumina having a specific surface area of about 220 $m^2/g$ was impregnated with an aqueous solution of dinitrodiammine Pt having a Pt concentration of about 4% by weight and an aqueous solution of rhodium nitrate having a Rh concentration of about 3% by weight, in which 3.2% by weight of Pt and 0.4% by weight of Rh were carried on the activated alumina. The powdered impregnated alumina was mixed with boehmite powder in a weight ratio of 3 (alumina):1 (boehmite powder), followed by adding 1% by weight of nitric acid-acidic alumina sol, thereby forming a mixture. The mixture was mixed with water and then pulverized for 60 minutes in a porcelain ball mill pot provided with alumina balls each having a diameter of 7 mm, thus obtaining a Rh—Pt containing slurry.

The zeolite containing slurry was coated on a cordierite ceramic honeycomb monolithic substrate (having the trade name of HONEYCERAM(R), produced by NGK Insulators, Ltd.) having a volume of 1.3 liters and 300 cells per square inch. The cells were formed extending throughout the length of the monolithic substrate so as to serve as gas passages through which exhaust gas flows. The coated monolithic substrate was dried and calcined thereby forming, on the monolithic substrate, a zeolite-silica mixture coat or catalytic layer having a weight of 200 g per one liter of the monolithic substrate.

This coated monolithic substrate was further coated with the Rh—Pt containing slurry, and then dried and calcined thereby forming, on the zeolite-silica mixture coat layer, a coat or catalytic layer having a weight of 100 g per one liter of the monolithic substrate, thus obtaining the HC adsorbing catalyst.

Example 17

An exhaust gas purifying system 17 was prepared by repeating the procedure of Example 14 with the exception that, in production of $H_2$ supplying catalyst, activated alumina (having a specific surface area of about 220 $m^2/g$) carrying 2% by weight of Pt was used in place of the activated alumina having a specific surface area of about 220 $m^2/g$ (to be mixed with $Pt/CeO_2$ catalyst powder).

Comparative Example 1

An exhaust gas purifying system R1 of Comparative example 1 was prepared by repeating the procedure of Example 1 with the exception that, in production of the flow-through monolithic carrier for combustion of SOF, silica having a specific surface area of about 120 $m^2/g$ and an average pore size of about 20 nm was used in place of the porous silica having a specific surface area of about 830 $m^2/g$ and an average pore size of about 3.2 nm.

Comparative Example 2

An exhaust gas purifying system R2 of Comparative example 11 was prepared by repeating the procedure of Example 11 with the exception that porous alumina having a specific surface area of about 180 $m^2/g$ and an average pore size of about 12 nm was used in place of the hectorite having a specific surface area of about 280 $m^2/g$ and an average pore size of about 7.8 nm.

Evaluation of Performance of Exhaust Gas Purifying System

Evaluation test for emission performance and pressure loss was conducted on the exhaust gas purifying system of Examples and Comparative Examples, using an evaluation engine system including an engine dynamometer provided with a four-cylinder cylinder-direct injection diesel engine having a displacement of 2.5 liters, equipped with a common rail fuel injection system. Each of the exhaust gas purifying systems of Examples and Comparative Examples was connected to the exhaust outlet of the engine. During the evaluation test, engine load of the engine could be changed to control a temperature (or system inlet gas temperature) of exhaust gas at the exhaust gas passageway upstream of the exhaust gas purifying system. Additionally, during the evaluation test, reducing the amount of intake air to be sucked into the engine and post fuel injection were made to obtain an exhaust gas condition in which exhaust gas had an air-fuel ratio (A/F) of 11.5, for 2 seconds subsequent to an engine operation for 40 seconds. Fuel used in the evaluation test was Swedish Class 1 diesel (fuel). The post fuel injection means an auxiliary fuel injection made subsequent to a main fuel injection.

(1) Emission Performance a) NOx, HC and CO

A steady state evaluation was made for emission of NOx, HC and CO under a steady state engine operation in which the system inlet gas temperature was kept at a constant level (250° C.). In this evaluation, the concentration (volume) of gas components (NOx, HC and CO) at an upstream part of the exhaust gas passageway and the concentration of the corresponding gas components at a downstream part of the exhaust gas passageway were measured thereby obtaining a "removal rate (% by volume)" of the gas components as shown in Table 1. The upstream part was located between the exhaust outlet of the engine and the exhaust gas purifying system, whereas the downstream part was located downstream of the exhaust gas purifying system. The removal rate (% by volume) was calculated by [(1−the concentration of the gas component at the downstream part/the concentration of the gas component at the upstream part)×100], in which the concentration was measured as "ppm". The measurement of the concentrations of the gas components was conducted at a timing of 10 hours after from the starting of operation of the engine for the evaluation test.

b) PM (SOF+Soot)

The steady state evaluation was made also for emission of PM (including SOF and soot) under the steady state engine operation in which the system inlet gas temperature was kept at the constant level (250° C.). In this evaluation, the concentration (weight) of PM at the upstream part of the exhaust gas passageway and the concentration of PM at the downstream part of the exhaust gas passageway were measured thereby obtaining a "removal rate (% by weight)" of PM as shown in Table 1. The upstream part was located between the exhaust outlet of the engine and the exhaust gas purifying system, whereas the downstream part was located downstream of the exhaust gas purifying system. The removal rate (% by weight) was calculated by [(1−the concentration of PM at the downstream part/the concentration of PM at the upstream part)×100]. The measurement of the concentrations of PM was conducted at the timing of 10 hours after from the starting of operation of the engine for the evaluation test.

(2) Pressure Loss Change

A transient state evaluation was made for pressure loss variation under a transient engine operation in which an engine operation pattern including a first step of maintaining the system inlet gas temperature at 150° C. for 3 minutes and a second step of maintaining the system inlet gas temperature at 350° C. for 30 seconds was repeated. In this evaluation, a first pressure loss (mmHg) of the exhaust gas purifying system at a timing before the evaluation test and a second pressure loss (mmHg) at a timing of 10 hours after from the starting of operation of the engine for the evaluation test were measured, thereby obtaining a "pressure loss variation (mmHg)" which was the difference of the first pressure loss from the second pressure loss, as shown in Table 1.

Table 1 reveals that the exhaust gas purifying systems within the scope of the present invention could five noxious components in exhaust gas at high efficiencies (removal rates) while hardly raising its pressure loss.

TABLE 1

| | Exhaust gas purifying system | | | | | | | |
|---|---|---|---|---|---|---|---|---|
| | Catalyst components in flow-through type catalyst | | | Steady state evaluation | | | | Transient state evaluation |
| Example | | Average pore sizes(nm) of SOF adsorbing material | Catalyst components in filter catalyst | NOx removal rate (%) | HC removal rate (%) | CO removal rate (%) | PM removal rate (%) | Pressure loss change (mmHg) |
| 1 | Pt/La · $SiO_2$ | 3.2 | Pt/Ce · $Al_2O_3$ | 52 | 73 | 90 | 75 | −4 |
| 2 | Pt/Ce · $SiO_2$ | 3.2 | Pt/Ce · $Al_2O_3$ | 53 | 72 | 89 | 80 | 4 |

TABLE 1-continued

| | Exhaust gas purifying system | | | | | | | | |
|---|---|---|---|---|---|---|---|---|---|
| | Catalyst components in flow-through type catalyst | | | | Steady state evaluation | | | | Transient state evaluation |
| | | | | Average pore sizes(nm) of SOF adsorbing material | Catalyst components in filter catalyst | NOx removal rate (%) | HC removal rate (%) | CO removal rate (%) | PM removal rate (%) | Pressure loss change (mmHg) |
| 3 | Pt/Fe · $SiO_2$ | | | 3.2 | Pt/Ce · $Al_2O_3$ | 48 | 72 | 93 | 77 | 0 |
| 4 | Pt/Mg · $SiO_2$ | | | 3.2 | Pt/Ce · $Al_2O_3$ | 49 | 72 | 92 | 72 | −8 |
| 5 | Pt/Zr · $SiO_2$ | | | 3.2 | Pt/Ce · $Al_2O_3$ | 50 | 70 | 89 | 78 | 1 |
| 6 | Pt/La · $SiO_2$ | | | 3.2 | Pt/La · $Al_2O_3$ | 52 | 72 | 90 | 72 | −5 |
| 7 | Pt/La · $SiO_2$ | | | 3.2 | Pt/Fe · $Al_2O_3$ | 50 | 70 | 90 | 74 | −4 |
| 8 | Pt/La · $SiO_2$ | | | 3.2 | Pt/Mg · $Al_2O_3$ | 51 | 69 | 92 | 74 | −5 |
| 9 | Pt/La · $SiO_2$ | | | 3.2 | Pt/K · $Al_2O_3$ | 52 | 71 | 90 | 78 | 0 |
| 10 | Pt/La · Mont. | | | 5.5 | Pt/Ce · $Al_2O_3$ | 53 | 72 | 88 | 72 | −6 |
| 11 | Pt/La · Hect. | | | 7.8 | Pt/Ce · $Al_2O_3$ | 53 | 69 | 88 | 80 | 5 |
| 12 | Pt/La · ZEO-β | | | 2.8 | Pt/Ce · $Al_2O_3$ | 48 | 78 | 90 | 80 | 4 |
| 13 | Pt/La · $SiO_2$ | Pt/Rh · $Al_2O_3$ | | 2.8 | Pt/Ce · $Al_2O_3$ | 65 | 72 | 91 | 80 | 4 |
| 14 | Pt/Ce | Pt/La · $SiO_2$ | Pt/Rh · $Al_2O_3$ | 2.8 | Pt/Ce · $Al_2O_3$ | 71 | 74 | 90 | 80 | 4 |
| 15 | Pt/Ce<br>Pt/La · $SiO_2$ | Pt/Rh · $Al_2O_3$ | | 2.8 | Pt/Ce · $Al_2O_3$ | 72 | 74 | 92 | 80 | 4 |
| 16 | Pt/Ce<br>Pt/La · $SiO_2$ | Pt/Rh · $Al_2O_3$ | Pt/Rh · $Al_2O_3$<br>ZEO-β/$SiO_2$ | 2.8 | Pt/Ce · $Al_2O_3$ | 70 | 85 | 91 | 80 | 4 |
| 17 | Pt/Ce<br>Pt/$Al_2O_3$ | Pt/La · $SiO_2$ | Pt/Rh · $Al_2O_3$ | 2.8 | Pt/Fe · $Al_2O_3$ | 67 | 70 | 92 | 80 | 4 |
| Comparative example | | | | | | | | | | |
| R1 | Pt/La · $SiO_2$ | | | 20 | Pt/Ce · $Al_2O_3$ | 32 | 68 | 88 | 90 | 25 |
| R2 | Pt/La · $Al_2O_3$ | | | 12 | Pt/Ce · $Al_2O_3$ | 40 | 65 | 85 | 86 | 14 |

As apparent from the above, according to the present invention, $NO_2$ existing in a limited amount in exhaust gas can be effectively used for combusting and removing dry soot upon separating SOF and dry soot in exhaust gas from each other and by treating separately SOF and dry soot. Accordingly, five noxious components, NOx, HC, CO and PM (including SOF and soot) in exhaust gas can be simultaneously removed respectively at high efficiencies for a long time, under exhaust gas conditions in which low exhaust gas temperatures of not higher than 200° C. frequently occur.

The entire contents of Japanese Patent Applications P2000-273771 (filed Sep. 8, 2000) and P2001-133085 (filed Apr. 27, 2001) are incorporated herein by reference.

Although the invention has been described above by reference to certain embodiments or examples of the invention, the invention is not limited to the embodiments or examples described above. Modifications and variations of the embodiments or examples described above will occur to those skilled in the art, in light of the above teachings. The scope of the invention is defined with reference to the following claims.

What is claimed is:

1. An exhaust gas purifying system comprising:

a flow-through monolithic catalyst disposed in an exhaust gas passageway through which exhaust gas flows, said monolithic catalyst functioning to adsorb and oxidize a soluble organic fraction in exhaust gas, to adsorb nitrogen oxides in exhaust gas in a condition in which a temperature of exhaust gas is not higher than 200° C. and to allow carbon particle in exhaust gas to pass through the monolithic catalyst; and a filter catalyst disposed in the exhaust gas passageway downstream of said flow-through monolithic catalyst, said filter catalyst functioning to trap the carbon particle and to oxidize hydrocarbons, carbon monoxide and nitrogen monoxide in exhaust gas.

2. An exhaust gas purifying system as claimed in claim 1, wherein said flow-through monolithic catalyst is of a honeycomb form and includes a coat layer, said coat layer including refractory inorganic oxide having a specific surface area of not larger than 250 $m^2/g$ and an average pore size ranging from 1 to 10 nm, and platinum carried on the refractory inorganic oxide.

3. An exhaust gas purifying system as claimed in claim 2, wherein said coat layer includes at least one selected from the group consisting of cerium, lanthanum, zirconium, iron, magnesium and potassium.

4. An exhaust gas purifying system as claimed in claim 1, wherein said flow-through monolithic catalyst includes a SOF adsorbing and oxidizing section for adsorbing and oxidizing the soluble organic fraction in exhaust gas, and a NOx adsorbing section for adsorbing nitrogen oxides in the condition in which a temperature of exhaust gas is not higher than 200° C., said SOF adsorbing and oxidizing section being located upstream of the NOx adsorbing section relative to flow of exhaust gas.

5. An exhaust gas purifying system as claimed in claim 4, further comprising a device for controlling a ratio of [hydrogen/all reducing components] at a value of not smaller than 0.5 at a location upstream of the NOx adsorbing section in a condition in which an air/fuel ratio of exhaust gas is smaller than 14.

6. An exhaust gas purifying system as claimed in claim 5, wherein said ratio controlling device includes a hydrogen supplying catalyst for supplying hydrogen in exhaust gas, said hydrogen supplying catalyst being disposed upstream of the NOx adsorbing section and containing at least one noble metal selected from the group consisting platinum, palladium and rhodium, and cerium.

7. An exhaust gas purifying system as claimed in claim 6, wherein the cerium carries the at least one noble metal in an amount of not less than 60% by weight of whole the at least one noble metal contained in the hydrogen supplying catalyst.

8. An exhaust gas purifying system as claimed in claim 6, wherein the SOF adsorbing and oxidizing section of said flow-through monolithic catalyst contains a SOF adsorbing and oxidizing catalyst component for adsorbing and oxidizing the soluble organic fraction, wherein the at least one noble metal and cerium of said hydrogen supplying catalyst and the SOF adsorbing and oxidizing catalyst components are carried on a single monolithic honeycomb substrate.

9. An exhaust gas purifying system as claimed in claim 2, wherein the refractory inorganic oxide contains an oxide of at least one metal selected from the group consisting of silicon, aluminum, titan and zirconium.

10. An exhaust gas purifying system as claimed in claim 2, wherein said refractory inorganic oxide is at least one selected from the group consisting of a layered clay mineral having a swelling property, and zeolite.

11. An exhaust gas purifying system as claimed in claim 10, wherein the layered clay mineral has a swelling property is smectite clay mineral.

12. An exhaust gas purifying system as claimed in claim 10, wherein said zeolite is at least one selected from the group consisting of MFI, zeolite β, mordenite, USY zeolite and ferrielite.

13. An exhaust gas purifying system as claimed in claim 2, wherein the refractory inorganic oxide has an average pore size ranging from 1 to 4 nm.

14. An exhaust gas purifying system as claimed in claim 1, wherein said filter catalyst includes a filter, and a catalyst component carried on the filter, the catalyst component including platinum.

15. An exhaust gas purifying system as claimed in claim 1, wherein said filter catalyst includes a fibrous inorganic compound which carries platinum.

16. An exhaust gas purifying system as claimed in claim 14, wherein the catalyst component includes at least one selected from the group consisting of cerium, lanthanum, zirconium, iron, magnesium and potassium.

17. An exhaust gas purifying system as claimed in claim 14, wherein the catalyst component includes an oxide of at least one selected from the group consisting of silicon, aluminum, titan and zirconium.

18. An exhaust gas purifying system as claimed in claim 17, wherein the oxide has an average particle size of not larger than 0.05 μm, wherein the oxide carries platinum.

19. An exhaust gas purifying system as claimed in claim 1, further comprising a HC adsorbing catalyst for adsorbing hydrocarbons in exhaust gas, disposed downstream of said flow-through monolithic catalyst relative to flow of exhaust gas.

20. An exhaust gas purifying system as claimed in claim 19, said HC adsorbing catalyst is disposed upstream of said filter catalyst relative to flow of exhaust gas.

21. An exhaust gas purifying system as claimed in claim 19, wherein said HC adsorbing catalyst includes a HC adsorbing catalyst component for adsorbing hydrocarbons, wherein said HC adsorbing catalyst component is carried in said filter catalyst.

22. An exhaust gas purifying system as claimed in claim 1, wherein said filter catalyst includes a plurality of filter catalysts which are arranged in series relative to flow of exhaust gas.

23. An exhaust gas purifying system as claimed in claim 22, wherein said filter catalyst includes a first filter catalyst having a first filter formed of a fibrous refractory inorganic compound, and a second filer catalyst having a second filter formed of a sintered body of refractory inorganic compound, the second filter catalyst being disposed downstream of the first filter catalyst relative to flow of exhaust gas.

24. An exhaust gas purifying system comprising:

a flow-through monolithic catalyst disposed in an exhaust gas passageway through which exhaust gas flows, said monolithic catalyst including means for adsorbing and oxidizing a soluble organic fraction in exhaust gas, means for adsorbing nitrogen oxides in exhaust gas in a condition in which a temperature of exhaust gas is not higher than 200° C., and means for allowing carbon particle in exhaust gas to pass through the monolithic catalyst; and a filter catalyst disposed in the exhaust gas passageway downstream of said flow-through monolithic catalyst, said filter catalyst including means for trapping the carbon particle, and means for oxidizing hydrocarbons, carbon monoxide and nitrogen monoxide in exhaust gas.

25. A method of purifying exhaust gas flowing through an exhaust gas passageway, comprising:

a first process accomplished in a flow-through monolithic catalyst disposed in the exhaust gas passageway, including adsorbing and oxidizing a soluble organic fraction in exhaust gas, adsorbing nitrogen oxides in exhaust gas in a condition in which a temperature of exhaust gas is not higher than 200° C., allowing carbon particle in exhaust gas to pass through the monolithic catalyst; and a second process accomplished in a filter catalyst disposed in the exhaust passageway downstream of the flow-through monolithic catalyst, including trapping the carbon particle in exhaust gas, and oxidizing hydrocarbons, carbon monoxide and nitrogen monoxide in exhaust gas.

26. A method as claimed in claim 25, wherein the exhaust passageway is of an internal combustion engine, wherein said method further comprises changing an air/fuel ratio of exhaust gas at a location near an outlet of the internal combustion engine during operation of the engine.

27. A method as claimed in claim 26, wherein the changing an air/fuel ratio including changing the air-fuel ratio at a value of not larger than about 14.

28. A method as claimed in claim 26, further comprising a regeneration treatment step which comprises: regulating an intake air amount, a fuel injection timing, an EGR rate, a fuel injection amount and a fuel injection pressure in the engine so as to change the air/fuel ratio at a value smaller than 14.7; controlling a ratio of in exhaust gas at a value of not smaller than 0.7 which exhaust gas is before subjected to adsorbing nitrogen oxides; and controlling a temperature of exhaust gas at a value of not lower than 500° C.

29. A method as claimed in claim 28, wherein controlling the exhaust gas temperature is carried out at intervals of consumption of an amount of fuel in the engine during operation of the engine.

* * * * *